US005711126A

United States Patent [19]

Wells

[11] Patent Number: 5,711,126

[45] Date of Patent: Jan. 27, 1998

[54] RESINOUS ANGLED SHINGLES FOR ROOF RIDGE LINES

[75] Inventor: James Randolph Wells, Heath, Ohio

[73] Assignee: Owens-Corning Fiberglass Technology, Inc., Summit, Ill.

[21] Appl. No.: 648,521

[22] Filed: May 13, 1996

[51] Int. Cl.[6] ..... E04D 1/20; E04D 1/30

[52] U.S. Cl. ..... 52/519; 52/57; 52/71; 52/98; 52/309.1; 52/533; 52/543; 52/560; 52/588.1; 52/591.4

[58] Field of Search ..... 52/57, 71, 309.1, 52/519, 533, 543, 560, 588.1, 591.4, 98

[56] References Cited

U.S. PATENT DOCUMENTS

| | | | |
|---|---|---|---|
| 1,404,483 | 1/1922 | Scharwath et al. . | |
| 2,168,218 | 8/1939 | Kirschbraun . | |
| 3,030,234 | 4/1962 | McClinton . | |
| 3,344,011 | 9/1967 | Goozner . | |
| 3,507,079 | 4/1970 | George . | |
| 3,579,940 | 5/1971 | Greenleaf . | |
| 3,608,261 | 9/1971 | French et al. . | |
| 3,830,687 | 8/1974 | Re et al. . | |
| 3,847,865 | 11/1974 | Duggins . | |
| 3,899,855 | 8/1975 | Gadsby . | |
| 3,903,340 | 9/1975 | Shepherd . | |
| 3,943,677 | 3/1976 | Carothers . | |
| 3,953,946 | 5/1976 | Peters et al. | 52/57 |
| 4,015,391 | 4/1977 | Epstein et al. . | |
| 4,015,392 | 4/1977 | Eaton . | |
| 4,028,450 | 6/1977 | Gould . | |
| 4,128,369 | 12/1978 | Kemerer et al. . | |
| 4,130,974 | 12/1978 | Chalmers et al. . | |
| 4,267,222 | 5/1981 | Sanders . | |
| 4,279,106 | 7/1981 | Gleason et al. . | |
| 4,288,959 | 9/1981 | Murdock . | |
| 4,307,552 | 12/1981 | Votte . | |
| 4,366,197 | 12/1982 | Hanlon et al. . | |
| 4,405,680 | 9/1983 | Hansen . | |
| 4,506,050 | 3/1985 | Hergenrother et al. . | |
| 4,514,947 | 5/1985 | Grail . | |
| 4,577,442 | 3/1986 | Callaway | 52/57 |
| 4,680,911 | 7/1987 | Davis et al. . | |
| 4,709,519 | 12/1987 | Liefer et al. | 52/98 |
| 4,760,679 | 8/1988 | Thompson . | |
| 4,864,787 | 9/1989 | Bukowski | 52/519 X |
| 5,048,255 | 9/1991 | Gonzales . | |
| 5,076,037 | 12/1991 | Crick et al. . | |
| 5,089,189 | 2/1992 | Staneluis et al. . | |
| 5,224,318 | 7/1993 | Kemerer . | |
| 5,244,850 | 9/1993 | Dutton . | |
| 5,295,339 | 3/1994 | Manner . | |
| 5,295,340 | 3/1994 | Collins | 52/57 X |
| 5,307,604 | 5/1994 | Tasso . | |
| 5,400,558 | 3/1995 | Hannah et al. . | |
| 5,455,099 | 10/1995 | Banner . | |
| 5,482,667 | 1/1996 | Dunton et al. . | |
| 5,527,128 | 6/1996 | Rope et al. | 52/588.1 X |

*Primary Examiner*—Christopher Kent
*Attorney, Agent, or Firm*—C. Michael Gegenheimer; Ted C. Gillespie

[57] ABSTRACT

An angled roofing shingle for a roof ridge line is made from an organic, resinous material and a filler material. The shingle has a first elongated portion and a separable, second elongated portion. These two portions each have a longitudinal edge provided with a mating edge surface and are joined together at an angle less than 180 degrees so that the shingle can cover and conform to the ridge line. Means are included for moving the first and second elongated portions relative to each other to change the angle of the shingle to accommodate a variety of angles of ridge lines.

20 Claims, 7 Drawing Sheets

FIG. 14
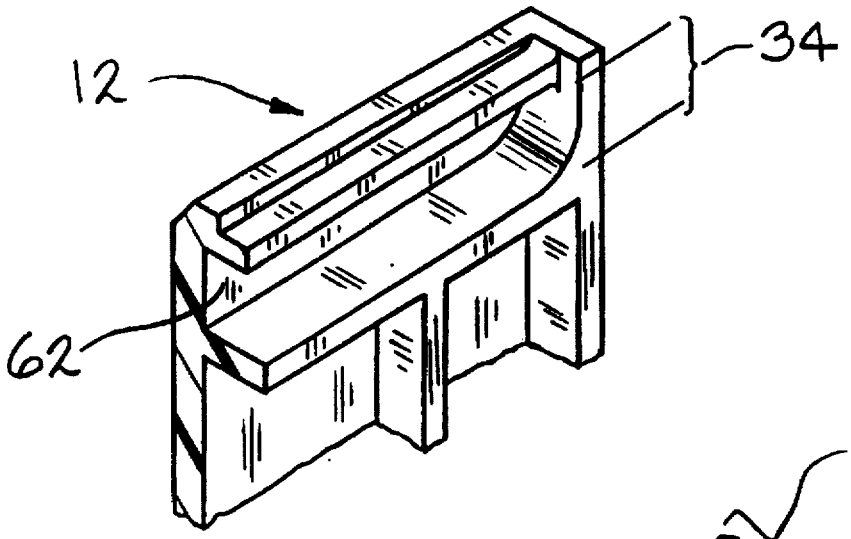
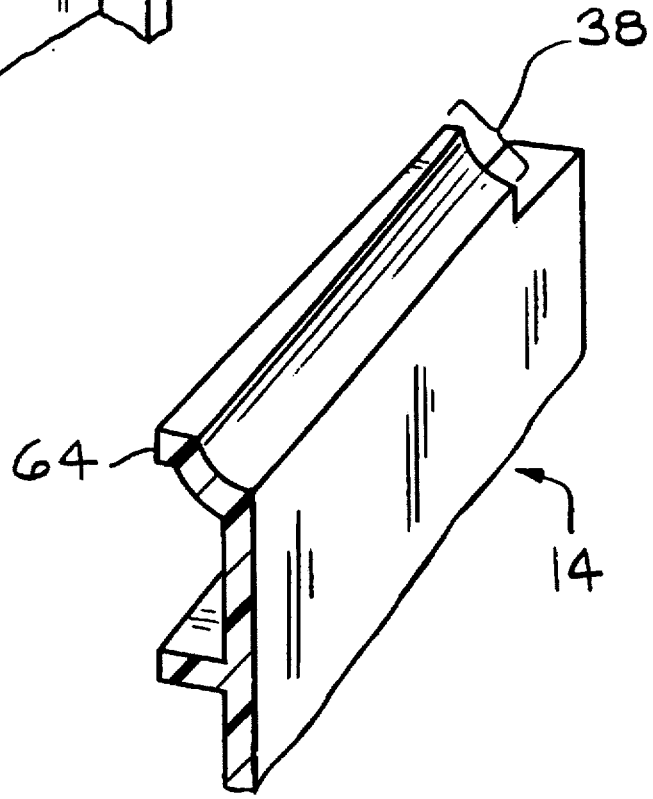
FIG. 15
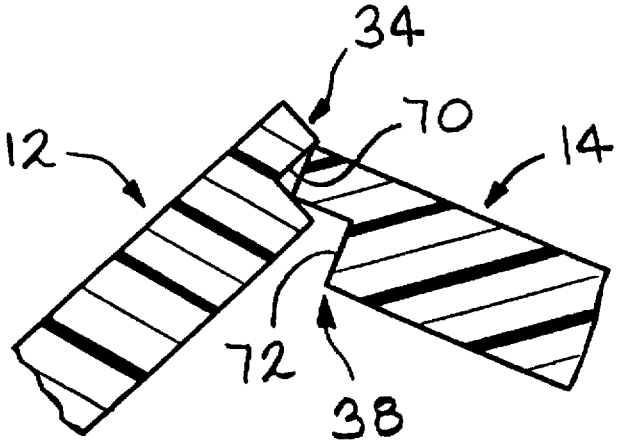
FIG. 16

RESINOUS ANGLED SHINGLES FOR ROOF RIDGE LINES

FIELD OF INVENTION

This invention relates to resinous angled shingles for covering the ridge lines of roofs. More specifically, the invention relates to hip and ridge accessory shingles made from resin and filler materials that may be used with primary forms of shingles, especially those that are similarly resinous, and help provide for the economic and easy assembly of a roof with an aesthetically pleasing appearance and enhanced weatherability. More particularly, this invention relates to angled shingles with elongated portions movable relative to each other, e.g., in a hinged fashion, to allow the shingles to accommodate or conform to a variety of ridge line angles.

BACKGROUND OF INVENTION

Conventional roof coverings for sloped roofs include asphalt shingles, wooden shake shingles, sheet metal, slate, clay, and concrete tile. Sheet metal, clay, and slate are advantageous because of their high weatherability. Various parts of the world have local or regional architectural preferences for the appearance of the roof. In Europe, clay tile is generally preferred over the relatively flat looking asphalt shingle. Tastes in the U.S. vary, with the western and southwestern part of the U.S. preferring clay tile or wooden shake shingles.

One of the problems with clay tile and slate roofs is that the clay and slate tiles require significant labor to apply. On the other hand, asphalt or wood shingles are nailable and are simply nailed to a roof deck in courses, usually from the bottom or eave to the top or ridge of the roof. Clay, concrete, and slate tiles are heavier than asphalt shingles, and require more support to hold up the roof. The installed cost of clay and slate tiles exceeds that of asphalt shingles. Clay and slate tiles are inherently fragile, and suffer much breakage during shipping and installation. Some of these materials are fragile even after installation on the roof, and can be damaged by foot traffic on the roof.

Wooden shake shingles are generally flat boards, usually of cedar or other coniferous trees. The wooden shakes are nailed in courses on the roof deck, with the exposed or tab portions of the shingles of a subsequent course being laid over the headlap portions of the previous course of shingles. The shingles are cut so that the wood grain runs up the slope of the roof for an aesthetically pleasing appearance. The cutting of the wood, and the subsequent weathering of the shingles after installation on the roof, create grooves and ridges running in the direction of the wood gain. A disadvantage of wooden shake shingles is that they absorb moisture and swell. Therefore, they must be applied in a spaced-apart arrangement to allow room for expansion. Because of the propensity of wooden shake shingles to absorb water, they tend to curl and not remain flat on the roof.

One of the desirable attributes of any roofing material is to be able to resist fires. This is particularly true in regions having a hot and dry climate, although fire resistance is desirable everywhere. A particularly important aspect of fire resistance is the ability of the roofing material to prevent a fire, or a source of heat such as a burning ember, from burning through the roofing material to thereby expose the roof deck or interior of the building to the fire. Metal roofs and clay and tile roofs have inherent advantages in fire resistance over wood shake shingle roofs. Asphalt shingles generally contain greater than 60 percent filler of freely ground inorganic particulate matter, such as limestone, and therefore are sufficiently fire-resistant to obtain a Class A fire rating when measured by appropriate tests. Wooden shake shingles, even when treated with a fire retardant material, are not generally fire-resistant and cannot achieve a Class A fire rating. Shake shingles are particularly prone to failing the fire tests (absent fireproofing underlayments) because the shingles cannot be placed with side edges abutting, and the gaps between adjacent shingles contribute to the failure of the shake shingles to pass the fire tests.

Attempts have been made in the past to make cement, synthetic, or plastic shingles or tiles to replicate the aesthetically pleasing look of wooden shake roof or tile roofs. Various experiments have been tried to make reinforced cement shingles or tiles. Weatherability and long-term stability of color can be a problem. Likewise, synthetic or plastic shingles or tiles have generally not been successful in replacing traditional roofing materials. The plastic material is typically too expensive in material costs, and traditional plastics do not weather well when exposed to sunlight in a roof application for extended periods of time. Further, the plastic material often lacks fire-resistant qualities.

Recent improvements and advancements have been made, however, so that aesthetically attractive primary shingles of resinous materials and fillers with advantageous properties can now be made, e.g., as disclosed in U.S. patent application Ser. No. 08/427,340, filed Apr. 24, 1995, by Wells et al., the disclosure of which is hereby incorporated by reference. It would be desirable to provide further improvements in shingles made of a plastic material having an aesthetically pleasing appearance, e.g., the appearance of a wooden shake shingle, which are superior to the wooden shake shingle in both weatherability and fire resistance, are light in weight, low in manufacturing cost, and have a generally long-lasting or permanent color. In particular, there is still a need for resinous accessory shingles, such as coveting pieces for the intersection of sundry roof planes at hips and ridges that share advantageous attributes of the resinous shingles disclosed by Wells et al.

Moreover, there is a need for shingles for ridge lines that provide for convenient adjustment of the angle to conform to the particular roof angle and that can be readily manufactured and applied to a roof. Conventional hip and ridge pieces typically come in separated left and right parts that are fit together by the roofer to form the ridge line covering.

SUMMARY OF INVENTION

By the present invention, a convenient and advantageous resinous angled shingle for covering the ridge line of a roof is attained. In general, the angled shingle has a first elongated portion and a distinct, second elongated portion, the first elongated portion having a longitudinal edge provided with a mating edge surface, and the second elongated portion having a longitudinal edge provided with a mating edge surface. The mating edge surfaces of the first and second elongated portions are movably or hingedly joined together at an angle less than 180 degrees to form the angled shingle capable of covering the ridge line of a roof. The first and second elongated portions can be moved relative to each other to change the angle of the shingle to accommodate or conform to the angle of the ridge line of the roof.

Preferably, the mating edge surfaces of the first and second elongated portions are joined via shiplapping or nesting to form a water-shedding joint. In a preferred embodiment of accomplishing this, the mating edge surface of the first elongated portion has a concave groove and the mating edge of the second elongated portion has a protruding lip fitting into the groove to join the first and second elongated portions in a hinged relationship or articulated fashion.

In a preferred embodiment of the invention, the first and second elongated portions initially are an integrally molded, single part in a generally flat form with means for separating the portions, such as a breakable mold strip connecting the first elongated portion to the second elongated portion so that the first and second elongated portions are capable of being easily separated from each other by hand along the mold strip by breaking or tearing. When separated, the first and second elongated portions are capable of being joined together at any angle less than 180 degrees to form an angled shingle capable of covering the ridge line of a roof and thereby capable of accommodating various angles of the ridge line of the roof.

A shingle according to the invention is generally made from ingredients comprising an organic, resinous material and a filler material. The shingle is preferably pressure molded, either by compression molding, injection molding, or some other similar molding technique. The organic, resinous material in the shingle is preferably present in an mount of from about 12 to about 35 percent by weight, and the filler material is preferably present in an mount of from about 65 to about 88 percent by weight. The high amount of inorganic filler material contributes to a Class A fire-resistance rating.

In a preferred shingle the resinous material comprises a polyester resin derived from input stock containing polyethylene terephthalate. The filler material preferably comprises one or more fillers selected from clay particles, slate particles, shale particles, and glass fibers. In one embodiment of the invention, the shingle composition contains no added pigment, and the color of the shingle is essentially filler material. In a preferred embodiment, the resinous shingle composition consists essentially of resinous material and filler material.

The shingle preferably includes means for affixing or fastening the shingle to a roof deck, preferably by nailing, to form an aesthetically pleasing roof coveting having high weatherability. Also, the shingle is preferably textured for use in shake-type roofs.

BRIEF DESCRIPTION OF DRAWINGS

FIG. 14 is a schematic view in perspective of the underside of a portion of the headlap end of the left elongated portion shown in FIG. 4.

FIG. 15 is a schematic view in perspective a portion of the headlap end of the right elongated portion shown in FIG. 8.

FIG. 16 is a schematic cross-sectional view in elevation of an alternate embodiment of the invention having kerfed elongated portions joined together to form an angled shingle.

DETAILED DESCRIPTION AND PREFERRED EMBODIMENTS OF INVENTION

Figure 1:
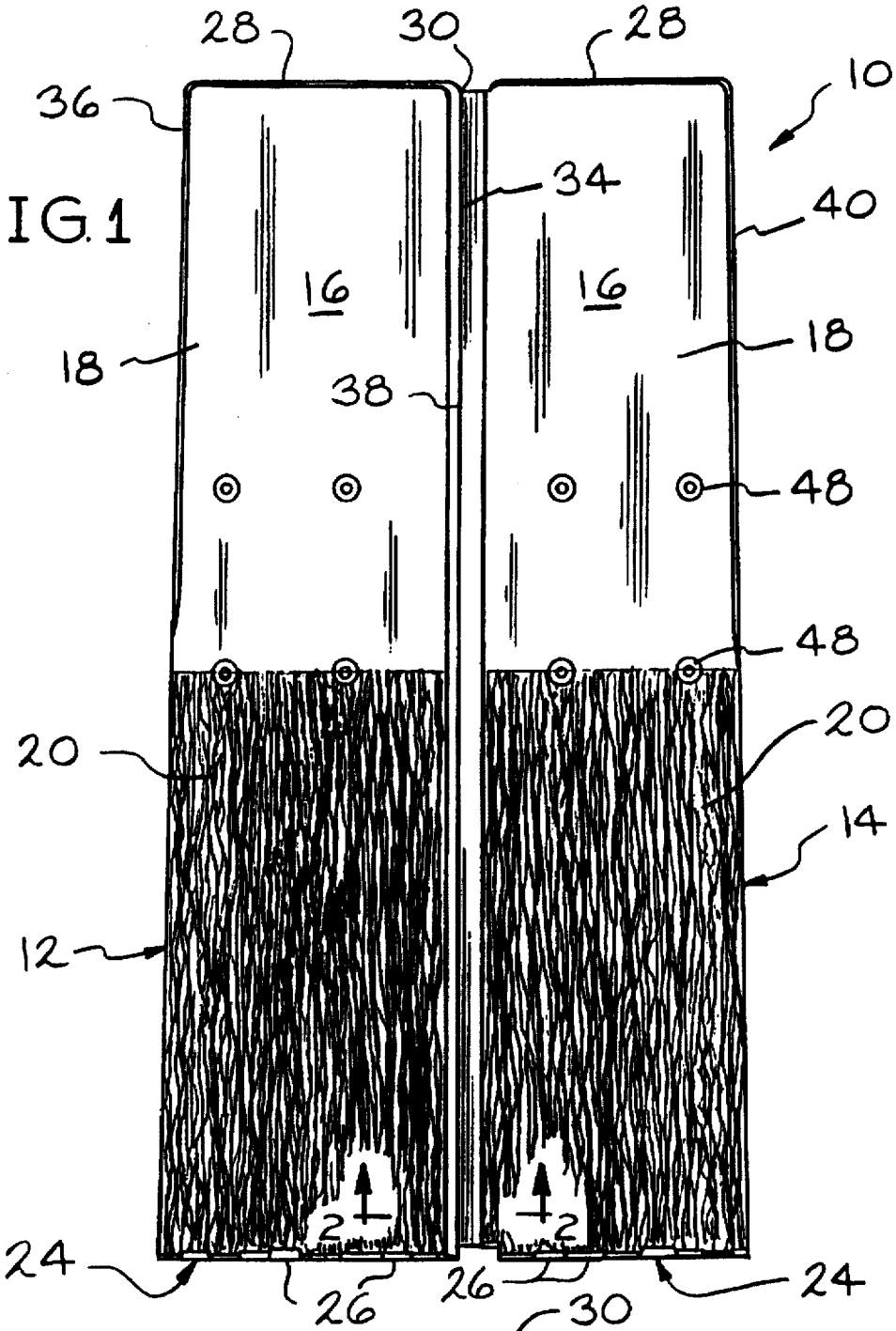
FIG. 1 is a schematic plan view of first and second elongated portions of a shingle of the invention molded together as a single part.

In one general embodiment of an angled roofing shingle for covering a ridge line of a roof, the shingle has a composition made from ingredients comprising an organic, resinous material and a filler material, and the shingle comprises a first elongated portion including a longitudinal edge with a mating edge surface, and a distinct, second elongated portion having a longitudinal edge with a mating edge surface. The mating edge surfaces of the first and second elongated portions are joined together at an angle less than 180 degrees to form an angled shingle for covering a ridge line of a roof via means for moving the portions relative to each other to change the angle of the shingle to conform to the angle of the ridge line. Preferred means for moving includes a concave groove on the mating edge surface of the first elongated portion and a protruding lip on the mating edge of the second elongated portion fitting into the groove to hinge the first and second elongated portions together. Preferably, means are included for joining the first and second elongated portions together by nesting to form a water-shedding joint. The mating edge surface of the first elongated portion preferably overlaps the mating edge surface of the second elongated portion. In a preferred embodiment, the mating edge surfaces are shiplapped. Each of the first and second elongated portions preferably includes a tab portion that after application will be exposed on the roof and a headlap portion that after application will be covered up on the roof, with each headlap portion preferably having preformed apertures, such as nail holes, for receiving suitable fasteners. In a preferred embodiment, each of the first and second elongated portions includes means for defining a cavity on the underside of the elongated portion, e.g., a top surface, two edge or side surfaces, an upper end, and a butt end. Ribs, preferably both transverse and longitudinal ribs, are positioned within the cavity.

The invention will now be illustrated with reference to specific, preferred embodiments of angled shingles having a wood shake appearance. It is to be understood, however, that the terms "shingles" and "roofing shingles" as used herein also include other types of shingles, as well as tiles and panels. Further, the shingles of the invention can have appearances other than wood shake shingles, such as, for example, slate panels or tiles, such as mission tiles.

As shown in FIGS. 1–4, the shingle, generally indicated at 10, has a first or left elongated portion 12 and a second or right elongated portion 14. For purposes of discussion, they will be referred to as the left half and right half, respectively, although it is to be understood that they do not need to be of equal size and can be in a shape other than the illustrated rectangular shape, such as a square.

The top surfaces 16 of the left half 12 and the right half 14 are divided into headlap portions 18 and tab portions 20. In normal application of the shingles onto a roof, the headlap portion 18 of each shingle is covered by the exposed or tab portion 20 of the next shingle. As shown, the tab portion 20 of each shingle half has a multiplicity of grooves or similar texture markings running in a direction along the length of the shingle to give the appearance of a wooden shake shingle. The butt end 24 of each shingle half preferably has a plurality of oblique surfaces 26 at differing angles to the butt end to provide the viewer with something other than a simple, straight butt end of the shingle. This will greatly enhance the aesthetic appearance of the shingle. The end opposite the butt end 24 is the upper end 28.

Figure 2:
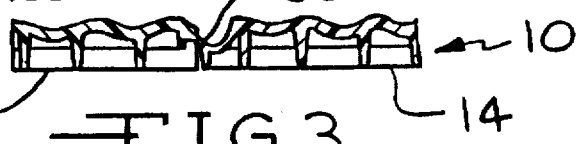
FIG. 2 is a cross-sectional view in elevation taken along line 2—2 of FIG. 1.
Figure 3:
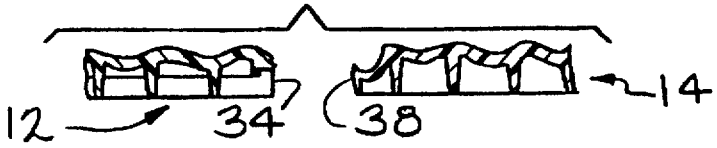
FIG. 3 is a cross-sectional view of a shingle of the invention similar to that of FIG. 2, but with the two elongated portions separated from each other.
Figure 4:
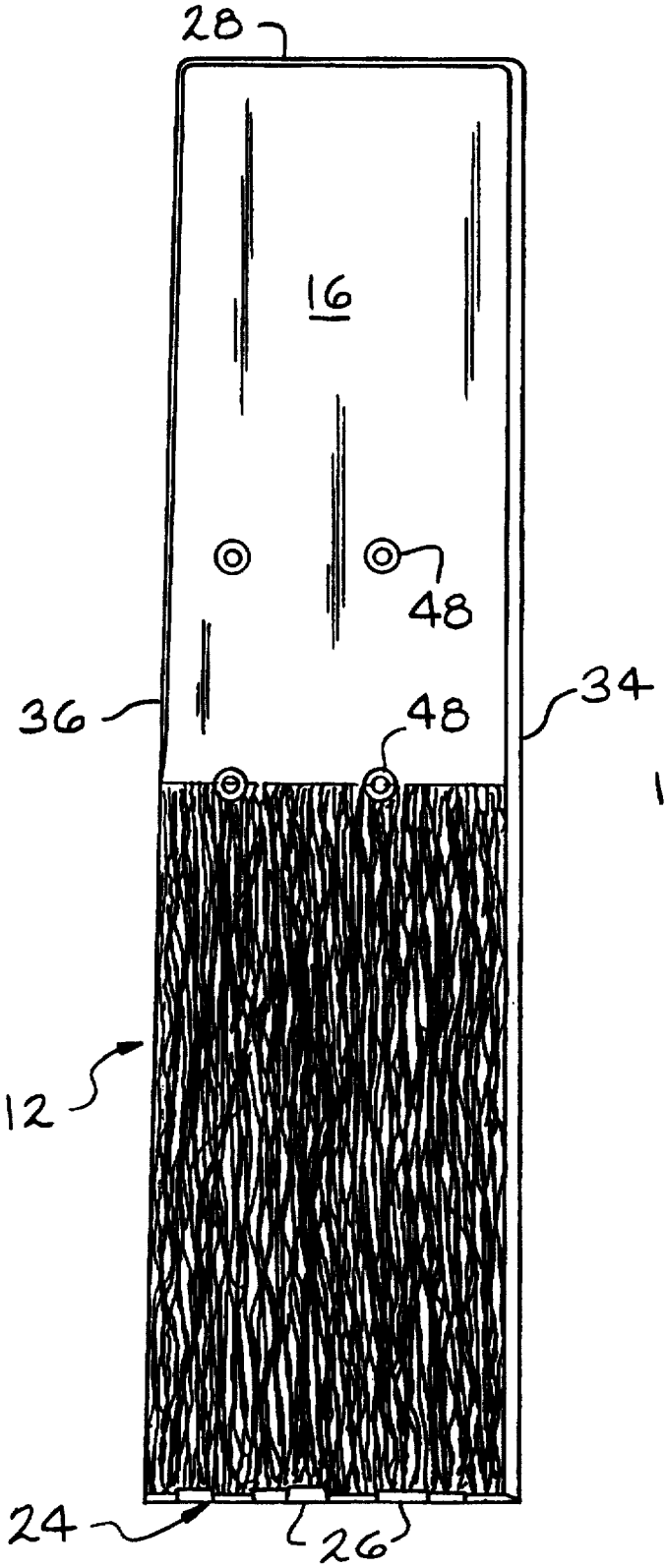
FIG. 4 is a schematic plan view of the left elongated portion of FIG. 1, after separation.
Figure 5:
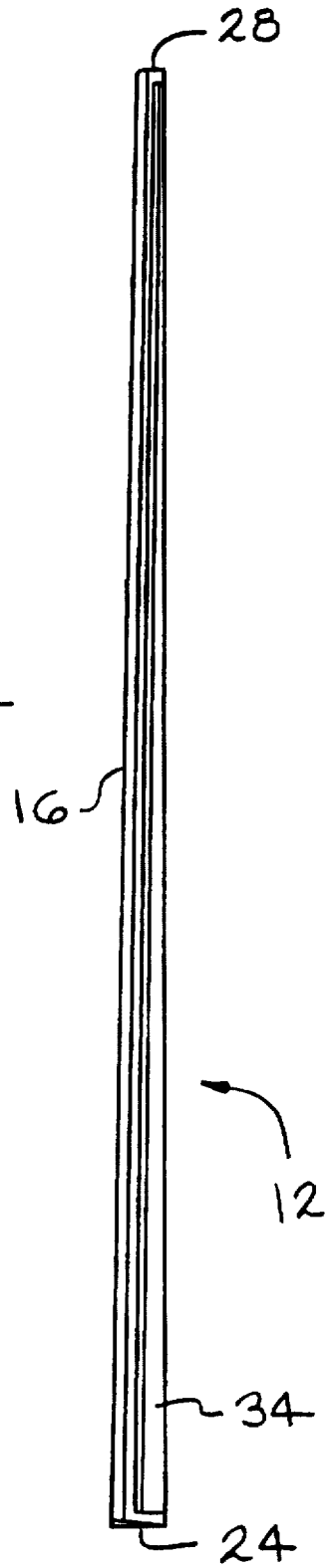
FIG. 5 is a schematic view in elevation of the side of the left elongated portion of FIG. 4.
Figure 6:
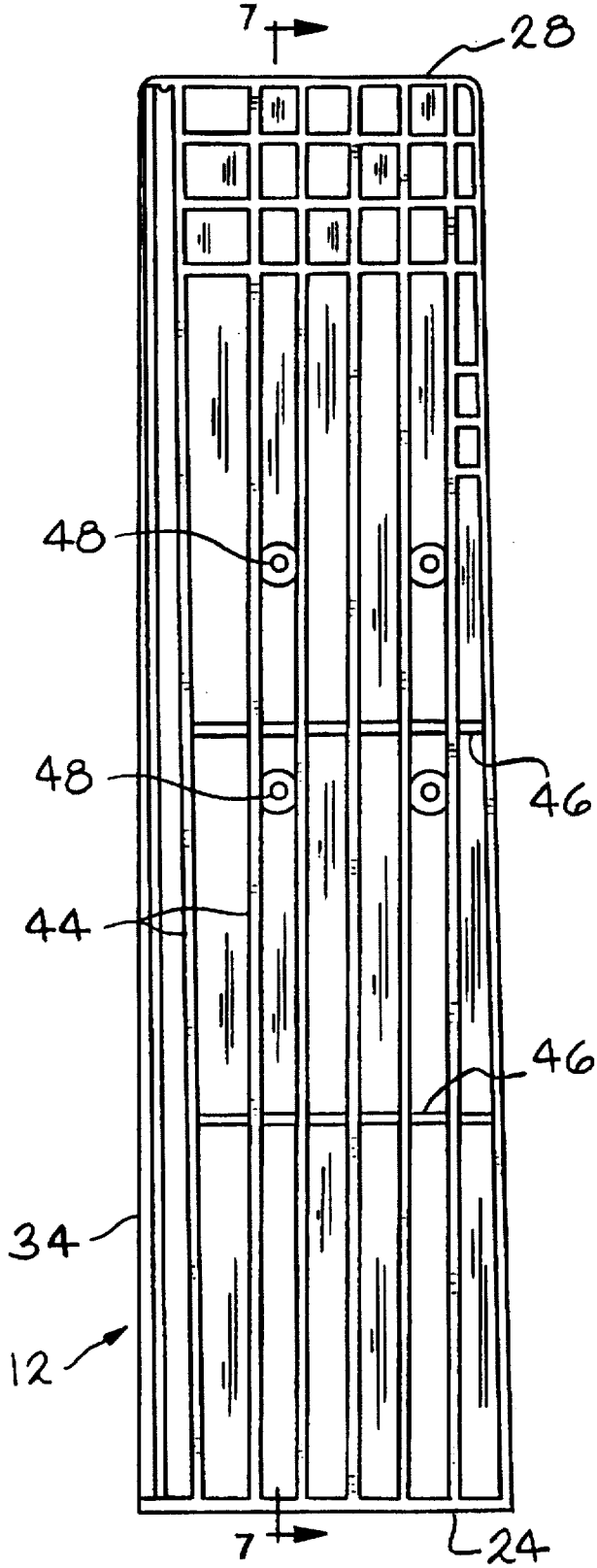
FIG. 6 is a schematic plan view of the underside of the left elongated portion shown in FIG. 4.
Figure 7:
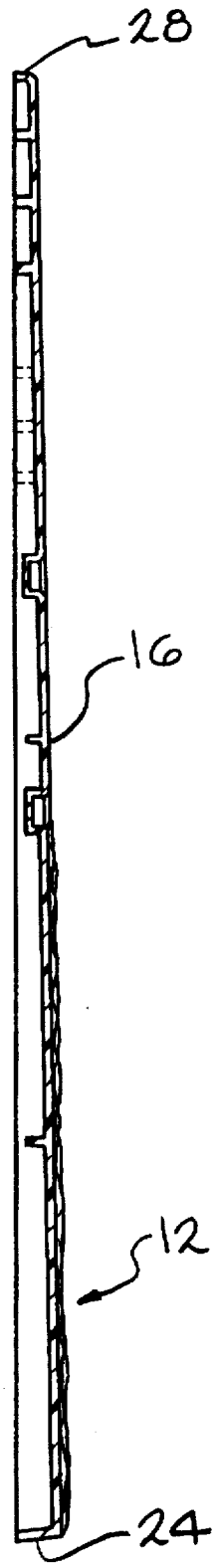
FIG. 7 is a cross-sectional view of the left elongated shingle taken along line 7—7 of FIG. 6.
Figure 8:
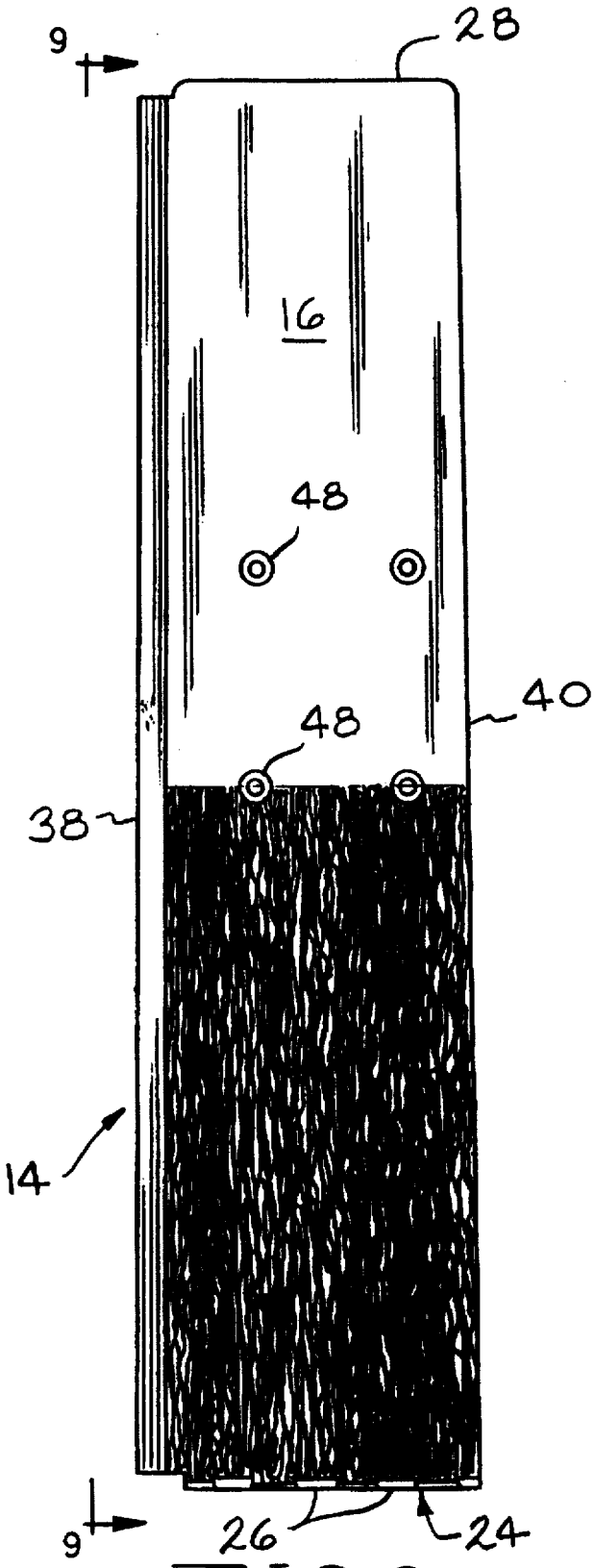
FIG. 8 is a schematic plan view of the right elongated portion of FIG. 1, after separation.
Figure 9:
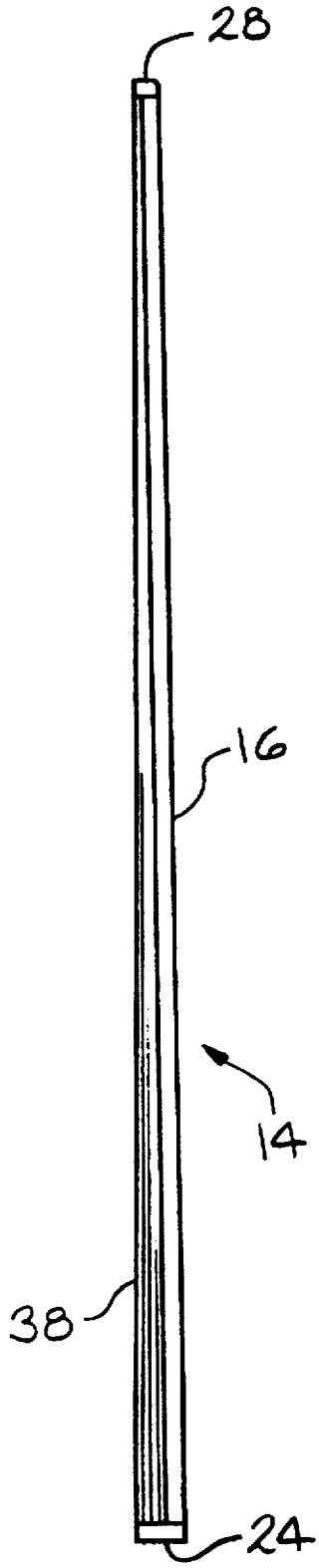
FIG. 9 is a schematic view in elevation of the left side of the right elongated portion of FIG. 8.
Figure 10:
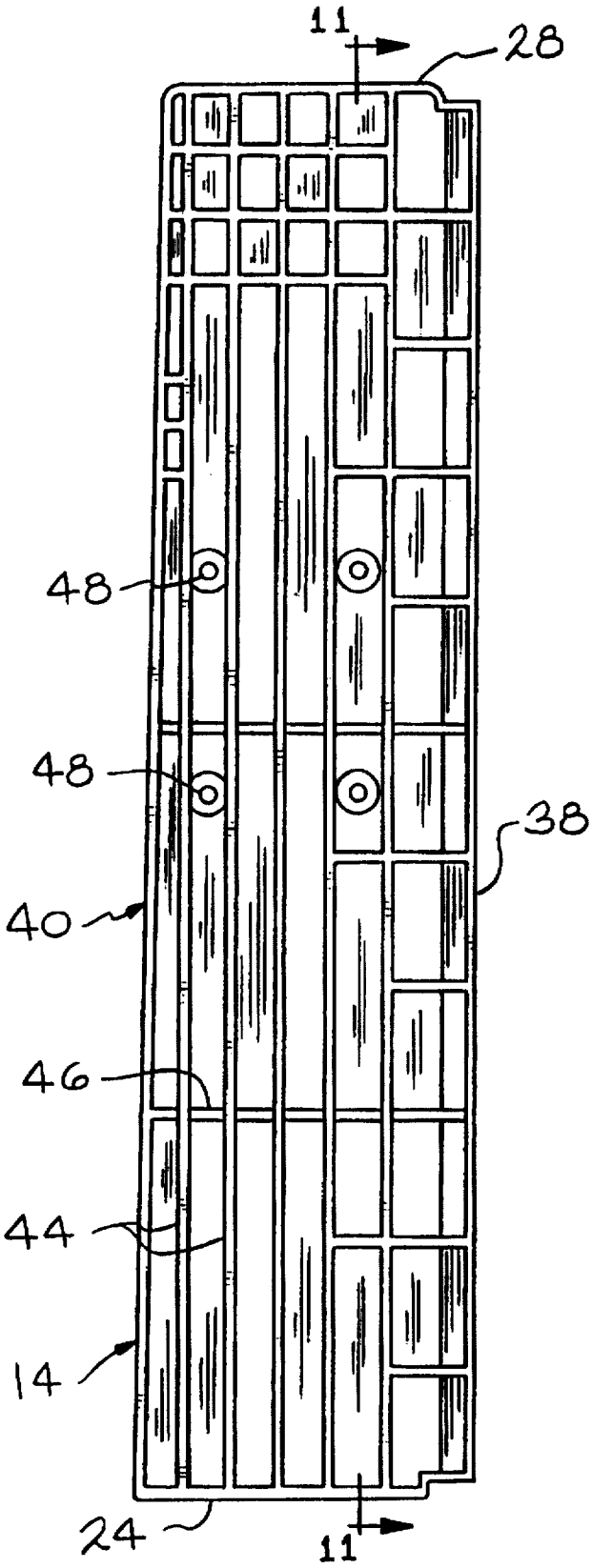
FIG. 10 is a schematic plan view of the underside of the right elongated portion shown in FIG. 8.
Figure 11:
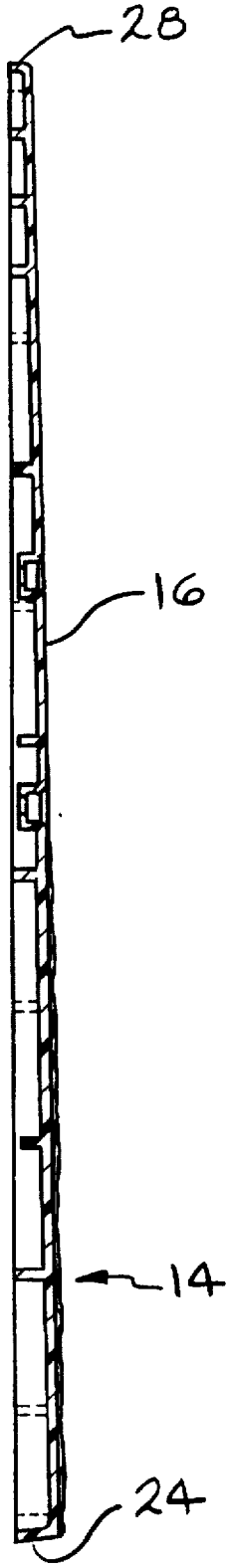
FIG. 11 is a cross-sectional view of the right elongated shingle taken along line 11—11 of FIG. 10.

As can be seen in FIG. 2, the left and right halves are connected together, preferably integrally molded as a single part, in a generally planar or flat form. The two shingle halves 12 and 14 are molded or held together by a connecting web or mold strip 30 of resinous material. The mold strip enables the shingle to be molded, shipped, and stored as a single unit, and then to be broken or split into the two shingle halves or portions. The mold strip is preferably sufficiently thin so as to enable the shingle to be separated into the left and right halves by hand. In cross-section, a preferred mold strip has a length of about 0.140 inches (3.6 mm) extending from the left half shingle to the right half shingle, and the preferred mold strip has a thickness of about 0.085 inches (2.2 nun) to enable the mold strip to be easily broken when desired. Additionally, score lines or the like may be added to facilitate breaking. By molding the two shingle halves into a single shingle with a mold strip, the molding and shipping processes are advantageously made simple and more efficient while enabling the roofer to break the mold strip to separate the shingle into the two halves and then join them together to form an angled shingle for use on a ridge line of a roof.

The left half 12 has two side or longitudinal edge surfaces—left mating edge surface 34 and an outer edge 36. The right half 14 has two side or longitudinal edge surfaces—right mating edge surface 38 and outer edge 40. As can be seen in FIGS. 4–7, the left half has top surface 16, side or edge surfaces 34 and 36, upper end 28, and butt end 24, which define a cavity on the underside of the left half 12. Likewise, as shown in FIGS. 8–11, the right half has top surface 16, side or edge surfaces 38 and 40, upper end 28, and butt end 24, which define a cavity on the underside of the right half 14. Preferably the side surfaces, the upper end, and the butt end of each half all extend downwardly from the top surface to the extent that the bottom edges of the side surfaces and upper and butt ends all lie in a common plane. It can be seen from FIGS. 5 and 7 that the right and left halves are tapered longitudinally, being thicker at the butt end 24 and thinner at the upper end 28.

As shown, fibs 44 are molded into the cavity of the left and right halves to strengthen the shingle. The fibs can be of any layout or design, and are shown here as being conveniently arranged generally parallel to the edges of the shingle halves. One of the functions of the fibs is to provide integrity to the shingle so that when affixed to the roof with fasteners such as staples or nails, the shingle will not split or tear away from the fasteners. Another function of the ribs is to provide sufficient flexural strength and rigidity for the product with efficient use of material. The ribs are preferably molded integrally with the top surface 16. If the ribs are made to extend downwardly into the cavity to the extent that the bottom edges of the ribs lie in a common plane as illustrated, then the fibs can support the top surface of the shingle. This will enable the shingle to be supported so as to help prevent sagging when the shingle is in a heated condition, such as during the cool-down phase following the molding process, or during storage of the shingles, or after application to a roof.

Preferably, the shingle is also provided with several side ribs 46, which are generally perpendicular to the edges of the shingle halves. These ribs 46 prevent a shingle from nesting within an adjacent shingle while the shingles are packaged in a bundle. Such nesting is where one of the side surfaces slides or slips into the cavity of an adjacent shingle in a bundle. The nesting of the shingles after they are packaged in a bundle is undesirable because it makes the bundle smaller, thereby having the effect of loosening the bundle.

The preferred method for applying the shingles to the roof is by driving nails through molded nail holes 48. Optionally other means for affixing or fastening the shingles to a roof, such as nailing strips (not shown), can be provided in the top surface 16 of the shingle halves to indicate to the roofer the best location for the fasteners (e.g., nails or staples) to be applied to the shingle. Such nailing strips preferably contain ridges (not shown) molded into the surface of the shingle to make a stronger structure for nailing purposes.

Figure 12:
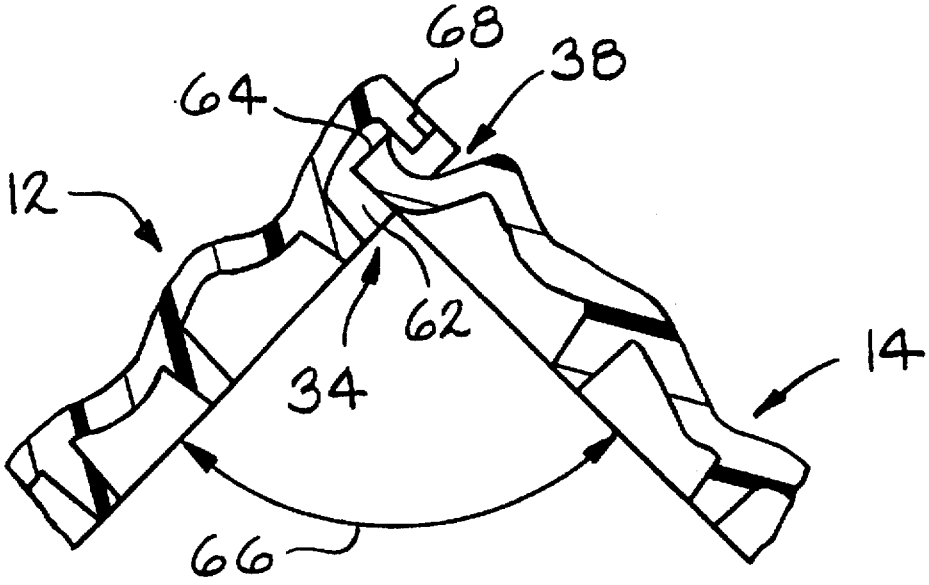
FIG. 12 is a schematic cross-sectional view in elevation showing the left and right elongated portions joined together to form an angled single of the invention.
Figure 13:
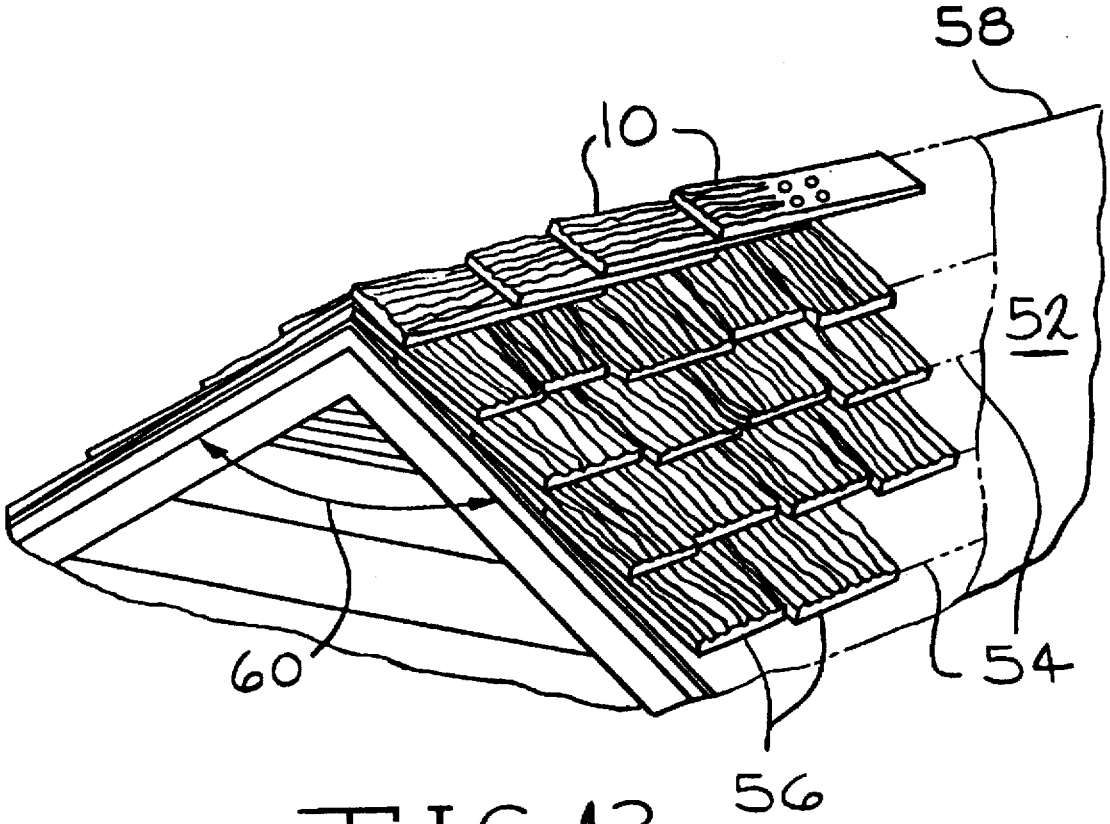
FIG. 13 is a schematic view in perspective of a roof containing shingles of the invention.

As shown in FIGS. 12 and 13, the left and right halves 12 and 14 are joined together for forming an adjustably angled shingle capable of being applied to the ridge line of a roof. The term "ridge line" encompasses roof ridges, roof hips, roof peaks, and other similar joints or roof intersections where a roof section in one plane intersects a roof section in another plane. As shown in FIG. 13, the shingles are being applied as part of a roof covering on a roof. The roof comprises an appropriate support structure such as joists or rafters (not shown) and a roof deck 52, which can be made of intermittently spaced boards (not shown) or continuous boards as shown. A water-resistant roofing felt 54 is preferably applied to the roof deck. Primary, e.g., planar shake, shingles 56 are laid in courses from the bottom up, and provide an aesthetically pleasing appearance. At the ridge line 58, the angled shingles 10 of the invention are applied to accommodate or conform to the angle 60 of the ridge line. The angled shingles are applied in a sideways fashion, rather than in the vertical orientation of the primary shingles 56. It can be seen that each shingle 10 is applied with its tab portion laid on top of the headlap portion of the previous shingle.

As shown in FIGS. 12, 14, and 15, the mating edge surface 34 of the left half 12 has a concave groove 62, and the mating edge surface 38 of the right half 14 has a projection or protruding lip 64. The protruding lip can be fitted, inserted, or nested into the groove to join the left and right shingle halves in a manner similar to a hinge, which will allow the two halves to be articulated or moved relative to each other to adjust or vary the angle 66 formed between the two halves to accommodate or conform to the angle 60 of the ridge line of the roof. The two shingle halves are preferably capable of being articulated to an angle 66 of from 0 to 180 degrees, e.g., of about 90 degrees. Preferably, the left half is provided with an overlapping flange 68, which overlaps the protruding lip of the mating edge surface 38.

Two important advantages of the shingles are that they provide an aesthetically pleasing appearance and protect the waterproofing felt 54 from the effects of weathering, particularly from ultraviolet radiation. The joining of the mating edge surfaces 34 and 38 also is preferably done using means creating a water-shedding joint, which allows for most or all of the water landing on the roof to nm off on the top surfaces 16 of the shingles.

As shown in FIG. 16, in an alternate embodiment of the invention, the mating edge surfaces 34 and 38 can be a pair of kerfed edges 70 and 72, respectively. The kerfed edges are shown joined together to form an angled shingle capable of covering the ridge line of a roof.

An important advantage of the invention is that the elongated portions may be efficiently molded integrally as a single part that can be readily broken or snapped apart in sire. Another significant advantage is that the inventive shingles have a configuration allowing for convenient joining of the elongated portions in a semi-interlocking or hinging manner at the point of application. A further advantage is that the angle between the two elongated portions may be suitably adjusted for a proper and water-shedding fit to the roof ridge line.

The composition of the shingle is preferably made from ingredients including an organic, resinous material in an amount within the range of from about 12 to about 35 percent by weight, and a filler material in an amount within the range of from about 65 to about 88 percent by weight. More preferably, the resinous material is present in an amount within the range of from about 15 to about 24 percent by weight, and the filler material is present in an amount within the range of from about 76 to about 85 percent by weight. In an especially preferred embodiment, the shingle composition comprises about 20 percent resinous material by weight and about 80 percent filler material by weight.

As used herein, the terms "resin" and "resinous material" mean any organic substance that can act as a matrix for the inorganic filler material. The resin or resinous material can be either a thermoplastic or thermoset, but is preferably a thermoset material. Examples of materials that are resinous and suitable for use with the invention include polyester, polyethylene terephthalate (PET), polycarbonate, and polypropylene resins. In general, the resins preferred are plastic resins containing no asphalt or only small amounts of asphalt, such as less than about 5 percent by weight. Thermoset polyester resins are especially preferred. Preferably, up to about 40 percent by weight PET can be added to the input stock in the resin process. This provides more flexibility to the shingle. Examples of resins suitable for use with the invention include resins E-606, E-650, E-120, and 55M-70 available from Alpha/Owens-Coming, L.L.C., Memphis, Tenn. The resinous material can include small amounts of other materials such as mold release agents.

Numerous filler materials can be used with the invention. Examples include clay, aluminum trihydrate, glass fibers of various lengths, other fibrous reinforcements (organic or inorganic), and freely divided slate, shale, limestone, fly ash, bottom ash, and talc. The filler material is preferably finely ground or chopped. The particles should be small enough to blend into the resin matrix, especially when molded into narrow parts, such as the ridges and the ribs. The filler particles should not be too small or else the surface area will be so great as to excessively bind up all the resin, thereby requiring increased amounts of the resin, which is a much more expensive component of the composition than is the filler material.

Preferred fillers include slate dust that imparts a black color, green shale, red clay, and white clay. These fillers can be combined to provide commonly used wood shake shingle colors such as light brown, gray, and dark brown. By selecting the appropriate color for the filler material, the desired color of the molded shingle can be produced without the use of pigments. This is an advantageous feature of the molded shingle because experience has shown that molded roof tiles and shingles using pigments tend to bleach out or wear off and change color after the shingle has been subjected to weathering on a roof. It is preferred that any slate present have a fineness such that substantially all the material is capable of passing through an 18 mesh screen, and that any shale present also have a fineness such that substantially all the material is capable of passing through an 18 mesh screen.

Preferably, the composition includes no more than about five percent by weight, and more preferably about two to three percent by weight, chopped glass fibers, such as one-quarter inch 405 glass fibers available from Owens Coming, Toledo, Ohio. A smaller percentage of other reinforcement fibers, such as nylon fibers, may also be used. One of the advantageous aspects of this is that the flexural strength is at a level sufficient for the product requirements using only a small percentage of reinforcement fibers in the composition. A test for flexural strength is an International Congress of Building Officials (ICBO) test which measures the load carrying capacity of a material and simulates the loading of roofing materials installed over spaced sheathing.

The molding process includes mixing the resin and the filler by any suitable means, such as a bulk molding compound (BMC) mixer. A charge of the composition can be applied to a compression mold operating at a temperature of from about 250° F. (121° C.) to about 350° F. (177° C.), and at a pressure of from about 400 psi (2,760 kPa) to about 800 psi (5,520 kPa). If glass fibers are used, they are preferably added after nearly all the mixing is completed. Other molding processes, such as injection molding, transfer molding, or injection/compression molding, can be used with the invention.

A very advantageous attribute of shingles of the invention is that when applied to a roof they form a Class A fire barrier. The Class A fire barrier is determined by testing the roof according to ASTM test E 108-93 for flame spread, burning brand, and intermittent time. The shingles of this invention can successfully pass the fire test without additional fireproofing measures, such as application of additional layers of underlayment of Type 30 roofing felt or mineral surface cap sheets. The Class A fire rating can be achieved with the shingles of the invention, applied over either a solid wood deck or spaced sheathing, with an interleaved layer, such as 18-inch Type 30 felts, applied on 10-inch centers or less, as is traditional in the application of wood shake shingles.

The foregoing description is presented to illustrate preferred embodiments and aspects of the invention. It will be evident from the foregoing and routine practice of the invention that various modifications can be made to this invention without departing from its spirit. Thus, the invention should not be construed as being limited by the foregoing description, but as being defined by the appended claims and their equivalents.

What is claimed is:

1. An angled roofing shingle for covering a ridge line of a roof, the shingle having a composition made from ingredients comprising an organic, resinous material and a filler material, wherein the shingle comprises:

a first elongated portion including a longitudinal edge with a mating edge surface, and a second elongated portion having a longitudinal edge with a mating edge surface, the mating edge surfaces of the first and second elongated portions adapted to be joined together in a hinge-like configuration capable of being articulated to an angle from about 90 degrees to 180 degrees to form an angled shingle for covering a ridge line of a roof, the first and second elongated portions including means for moving the portions relative to each other to change the angle of the shingle to conform to the angle of the ridge line.

2. A shingle as defined in claim 1, where the shingle further comprises means for joining the first and second elongated portions together by nesting to form a water-shedding joint.

3. A shingle as defined in claim 2, wherein the means for moving includes a concave groove on the mating edge surface of the first elongated portion and a protruding lip on the mating edge of the second elongated portion fitting into the groove to join the first and second elongated portions together in a hinged relationship.

4. A shingle as defined in claim 1, wherein the means for moving includes a concave groove on the mating edge surface of the first elongated portion and a protruding lip on the mating edge of the second elongated portion fitting into the groove to hinge the first and second elongated portions together.

5. A shingle as defined in claim 1, wherein the mating edge surface of the first elongated portion overelaps the mating edge surface of the second elongated portion.

6. A shingle as defined in claim 1, wherein the mating edge surfaces are shiplapped.

7. A shingle as defined in claim 1, wherein each of the first and second elongated portions includes a tab portion that is adapted to be exposed on the roof after application of the shingle on the roof, and a headlap portion that is adapted to be covered up on the roof after application of the shingle on the roof.

8. A shingle as defined in claim 7, wherein each said headlap portion comprises preformed apertures for receiving fasteners.

9. A shingle as defined in claim 1, wherein each of the first and second elongated portions is molded; and the organic, resinous material is present in an amount of from about 12 to about 35 percent by weight, and the filler material is present in an amount of from about 65 to about 88 percent by weight.

10. A shingle as defined in claim 1, wherein the shingle is compression molded, the resinous material is a polyester resin derived from polyethylene terephthalate, and the shingle and has a color imparted essentially by the filler material.

11. A shingle as defined in claim 1, wherein each of the first and second elongated portions has an underside and includes a top surface, the mating edge surface and another edge surface, an upper end, and a butt end, which define a cavity on the underside of the elongated portion, and a plurality of ribs is positioned within the cavity.

12. A compression-molded angled roofing shingle made from ingredients comprising an organic, resinous material and a filler material, wherein the shingle comprises:

a first elongated portion including a longitudinal edge with a mating edge surface, a second elongated portion including a longitudinal edge with a mating edge surface, and means for movably joining the mating edge surfaces of the first and second elongated portions together to form a water-shedding, articulated joint at an angle less than 180 degrees, wherein the means for movably joining includes a concave groove on the mating edge surface of the first elongated portion and a protruding lip is on the mating edge of the second elongated portion for nesting in the groove to join the first and second elongated portions in a hinged relationship whereby the first and second elongated portions can be moved relative to each other to adjust the angle of the shingle to conform to the angle of the ridge line.

13. A shingle as defined in claim 12, wherein the resinous material is a polyester resin derived from input stock containing polyethylene terephthalate in an mount of from about 12 to about 35 percent by weight, and the filler material is present in an amount of from about 65 to about 88 percent by weight.

14. A roofing shingle for covering a roof ridge line made from ingredients comprising an organic, resinous material and a filler material, wherein the shingle comprises:

a first elongated portion including a longitudinal edge with a mating edge surface and a second elongated portion including a longitudinal edge with a mating edge surface, the first and second elongated portions being integrally molded together to initially form a single part in a generally flat form having means for removably connecting the first elongated portion to the second elongated portion whereby the first and second elongated portions may be separated from each other by hand and for hingedly joining the separated first and second elongated portions together at an adjustable angle less than 180 degrees whereby the angled shingle can conform to a roof ridge line.

15. A shingle as defined in claim 14, in which the means for removably connecting includes a breakable mold strip and the means for hingedly joining include nesting means for forming a water-shedding joint.

16. A shingle as defined in claim 15, in which the nesting means includes a concave groove in the mating edge of the first elongated portion and a protruding lip on the mating edge of the second elongated portion fitting into the groove.

17. A shingle as defined in claim 16, wherein the resinous material is a polyester resin in an amount of from about 12 to about 35 percent by weight, and the filler material is present in an amount of from about 65 to about 88 percent by weight.

18. A shingle as defined in claim 14, in which each of the elongated portions includes means for defining a cavity when separated and a plurality of transverse and longitudinal ribs positioned within the cavity.

19. A shingle as defined in claim 14, in which each of the first and second elongated portions includes a tab portion that is adapted to be exposed on the roof after application of the shingle on the roof, and a headlap portion that is adapted to be covered by another shingle on the roof after application of the shingle on the roof, and means for fastening the headlap portion to the roof.

20. A shingle as defined in claim 14, wherein the resinous material is a polyester resin derived from input stock containing polyethylene terephthalate in an amount of from about 12 to about 35 percent by weight, and the filler material is present in an amount of from about 65 to about 88 percent by weight, where each of the elongated portions has an underside, and, when separated, each of the elongated portions comprises a top surface, a mating edge surface and another edge surface, an upper end, and a butt end, which define a cavity on the underside of the elongated portion, and ribs positioned within the cavity.

* * * * *